United States Patent [19]

Gilliams et al.

[11] 4,138,351

[45] Feb. 6, 1979

[54] ELECTROPHORETIC LIQUID DEVELOPER CONTAINING A METAL ALKYL SULPHONATE

[75] Inventors: Yvan K. Gilliams, Hever; Noël J. De Volder, Edegem; Robert J. Pollet, Vremde; Bernard H. Tavernier, Edegem; Nikolaas C. De Jaeger, Ghent; Francis J. Sels, Kontich, all of Belgium

[73] Assignee: AGFA-GEVAERT N.V., Mortsel, Belgium

[21] Appl. No.: 723,190

[22] Filed: Sep. 14, 1976

[30] Foreign Application Priority Data

Sep. 16, 1975 [GB] United Kingdom ..... 38068/75

[51] Int. Cl.[2] ..... G03G 9/12

[52] U.S. Cl. ..... 252/62.1 L; 96/1 LY; 260/429 K; 260/429.9; 260/435 R; 260/438.1; 260/504 A; 260/513 R; 252/353

[58] Field of Search ..... 260/504 A, 513 R, 429 K, 260/429.9, 438.5 R, 439 R, 435 R, 438.1; 252/33, 535, 353, 62.1 L, 62.1 R; 96/1 LY

[56] References Cited

U.S. PATENT DOCUMENTS

| | | | |
|---|---|---|---|
| 3,337,615 | 8/1967 | Roberts | 260/513 R |
| 3,417,019 | 12/1968 | Beyer | 252/62.1 L |
| 3,463,809 | 8/1969 | Crocker et al. | 260/513 R |
| 3,681,243 | 8/1972 | Okuno et al. | 252/62.1 L |
| 3,793,032 | 2/1974 | Pollet et al. | 96/94 R |
| 3,897,470 | 7/1975 | Sias | 260/513 R |
| 3,917,722 | 11/1975 | Yates | 260/429.9 |

FOREIGN PATENT DOCUMENTS 1411739 10/1975 United Kingdom ..... 252/62.1 L

OTHER PUBLICATIONS

Morrison et al., "Organic Chemistry", Allyn & Bacon Inc., pp. 62, 63, 72, 73 c. 1959.

*Primary Examiner*—John D. Smith
*Attorney, Agent, or Firm*—William J. Daniel

[57] ABSTRACT

A liquid toner developer composition suitable for use in developing electrostatic charge patterns, characterized in that the developer contains a metal alkyl sulphonate ionic surfactant in which the metal ion is a bivalent metal ion selected from the group consisting of zinc(II), lead(II), cadmium(II) and copper(II) and the sulphonate group thereof is present directly on an alkyl chain containing at least 6 carbon atoms in a straight chain, which sulphonate has a positive charging effect on the toner, and the sizes of the toner particles and the amount in which said sulphonate is present are selected such that the toner can develop a charge pattern having a charge level corresponding to 50 V for a capacitance of $1.5\times10^{-11}$ F.cm$^{-2}$ up to an optical density of at least 0.8.

18 Claims, No Drawings

ELECTROPHORETIC LIQUID DEVELOPER CONTAINING A METAL ALKYL SULPHONATE

The present invention relates to electrostatography and more particularly to a method for the development of electrostatic charge patterns and to liquid developers used therefor.

An electrostatographic process known as electrophotography comprises the steps of electrostatically charging in the dark a photoconductive surface, image-wise exposing the said surface whereby the irradiated areas become discharged in accordance with the intensity of radiation thus forming a latent electrostatic image and developing the material to form a visible image by depositing on the image a finely divided electroscopic material known as "toner." The image thus developed may be fixed to the surface of the photoconductor or transferred to another surface and fixed thereon.

Instead of forming the electrostatic image by the steps described above, it is also possible to charge directly a dielectric material in image configuration.

A special method of producing electrostatic charge patterns that finds application e.g. in X-ray image recording is based on photo-emission of charged particles.

Processes in which the electrostatic image formation is based on photo-electron emission are described e.g. in the U.S. Pat. Nos. 2,221,776 of Chester F. Carlson issued Nov. 19, 1940, 2,692,948 of Kurt S. Lion issued Oct. 26, 1954, 2,900,515 of Edward L. Criseuolo and Donald T. O'Conner, issued Aug. 18, 1959, 3,057,997 of Edward K. Kaprelian issued Oct. 9, 1962 and 3,526,767 of Walter Roth and Alex E. Jvirblis issued Sept. 1, 1970, the United Kingdom patent specification No. 778,330 filed Apr. 15, 1955 by C^ie Francaise Thomson-Houston, the German Patent Specification No. 1,497,093 filed Nov. 8, 1962 by Siemens A. G., and the published German Patent Applications Nos. 2,231,954 and 2,233,538 filed respectively June 29, 1972 and July 7, 1972 by Diagnostic Instruments. Except for the processes described in the latter three patents, the photoelectron emission proceeds with a solid photocathode.

A particularly interesting electroradiographic recording technique is known as ionography. In ionography positive and negative charge carriers are formed image-wise between electrodes in an ionizable gas or liquid medium with the aid of image-wise modulated penetrating radiation. By the influence of the electric field between said electrodes one type of said charge carriers is deposited on a dielectric receptor material forming an electrostatic charge pattern thereon. Penetrating radiation includes X-rays, $\beta$-rays, $\gamma$-rays, fast electrons and neutrons capable of effecting ionization in a gas medium absorbing said radiation.

One embodiment of ionography is described by K. H. Reiss, Z. Angew. Phys., Vol. 19, Feb. 19, 1965, page 1 (see also German Patent Specification No. 1,497,093 mentioned before and published German Patent Application No. 2,226,130 filed May 29, 1972 by Siemens A. G.). Use is made of an arrangement of a pair of electrodes with a potential difference applied between them and a gas filling the gap between the electrodes. A dielectric sheet is mounted on the anode and the cathode is made of, or coated with a heavy electron-absorbing metal, such as lead. A typical gap width or interelectrode spacing is 0.5 mm, with the gas at atmospheric pressure in the gap, giving a gap width-pressure product in the order of 0.5 mm atmosphere. In operation the differentially adsorbed X-ray flux incident on the anode traverses the anode (made of a substance transparent to X-rays, such as aluminium or beryllium), traverses the gas with very little attenuation, and impinges on the cathode, which acts as a photoemitter, emitting a current into the gas, the current density emitted from a given area being proportional to the incident X-ray flux density. The gas in the gap acts as a gaseous amplifier, the initial current being amplified by electron multiplication and avalanche in the presence of an accelerating potential difference. In this manner the initial photoelectric emission current from the cathode is magnified considerably by as much as six orders of magnitude or possibly more.

According to another ionographic imaging system described in the U.S. Pat. No. 3,774,029 of Erik P. Muntz, Andrew P. Proudian and Paul B. Scott issued Nov. 20, 1973, the emitting cathode of the Reiss system is omitted as a primary source of electrons and replaced by an X-ray-opaque gas, e.g. having an atomic number of at least 36, preferably xenon at superatmospheric pressure which exhibits a very short stopping distance for the resulting photoelectrons produced therein. During the image-wise X-ray exposure, a potential difference is applied between electrodes over the gap comprising said gas and electrons, and positive ions formed in said gas are attracted and moved towards the anode and cathode respectively so that a charge pattern, e.g. developable as a continuous tone pattern, is formed with one of the types of charged particles on a dielectric receptor sheet. According to a modified ionographic system described in the U.S. Pat. No. 3,873,833 of Frank V. Allan, John H. Lewis, Katherine J. Lewis, Arthur L. Morsell, Erik P. Muntz, Paul B. Scott and Murray S. Welkowsky, issued May 25, 1975, the above defined X-ray-opaque gas is replaced by an X-ray-opaque and electrically non-conducting liquid.

Historically, a one-component dry powder toner was first used for developing electrostatic images. Other development processes, presently known as cascade, fur brush, powder cloud, magnetic brush and liquid electrophoretic development were introduced.

Developers of the electrophoretic type initially comprised basically a simple dispersion of a pigment but no binder. It was later proposed e.g. by Metcalfe and Wright, J. Oil Colour Chem. Ass., 39 (1956) 851-853, to use liquid developers incorporating resins and control agents. The resultant images are then made of so-called "self-fixing" toners.

In liquid developers comprising coloured toner particles suspended in an insulating carrier liquid, the volume resistivity of the liquid is preferably in excess of $10^9$ Ohm.cm and has a dielectric constant below 3. The suspended toner particles, usually finely divided pigments (which expression includes dyes in pigment form) obtain an electric charge of a definite polarity by the so-called charge control agent and develop the latent image under influence of the charge of the latent electrostatic image.

The use of negatively charged toner particle suspensions for change control agents of overbased metal alkyl sulphonates (oil-soluble micells of metal alkyl sulphonates with excess metal hydroxide or carbonate solubilized) has been described in Proc. IEEE, Vol. 60, No. 4, April 1972, page 363 and French Patent Specification No. 2,064,053 filed June 5, 1970 by N. V. Philips'Gloeilampenfabrieken.

According to the published Dutch Patent Application 67 10 385 filed July 27, 1967 by Radio Corporation of America alkylaryl sulphonates are used as control agents to provide a negative polarity to toner particles in an electrically insulating carrier liquid.

In the development of electrostatic charge patterns, there is a decay of the surface charge constituting the latent image, which implies that a charge neutralization mechanism is operative between the developer and the charge carrying surface.

Depending on the initial charge density of the charge carrying surface, the charge per toner particle and the saturation density of the toner, a certain optical density in the image portion is reached. If the charge of the toner particles is increased a higher surface charge density is required to achieve saturation density of toner, otherwise development is limited by the premature decay of surface charge. The saturation density of a toner is the maximum development density that can be obtained with that toner. Since the surface charge, which can be built up on a given charge-carrying surface is limited, it is necessary to ensure that the specific charge on the toner particles and the charge/particle mass ratio of the toner particles is such that an acceptable degree of optical density of the toner image is obtained.

The developable surface charges of dielectrics used in electrostatography vary between about $6.0\times10^{-7}$ and about $3.0\times10^{-9}$ C.cm$^{-2}$ (Coulomb per sq.cm).

Since in most cases charge images obtained through ionography correspond with a surface charge of only about $3\times10^{-9}$C, which is approximately 10 to 20 times smaller than the charges to be developed in electrophotographic zinc oxide coatings, there is a need in ionography for electrophoretic toners that can develop low charge level images with sufficient optical density.

Electrostatic charges on dielectric recording materials are normally defined by the voltage difference that exists between the charged surface and the ground. A low charge level corresponds e.g. with a voltage difference of at most 150 V for a capacitance of $2\times10^{-11}$ F.cm$^{-2}$ (Farad per sq.cm). The capacitance is directly proportional to the dielectric constant of the support and inversely proportional to the thickness of the support carrying the charge image.

It is an object of the present invention to provide an electrophoretic developer which is capable of depositing positively charged toner particles up to an optical density of at least 0.8 on a negatively charged dielectric surface having a charge level corresponding with 50 V for a capacitance of $1.5\times10^{-11}$ F.cm$^{-2}$.

It is another object of the present invention to provide a method of electrophoretic development in which latent negative surface charge patterns obtained on an insulating resin support, e.g. through ionography, are developed with positively charged toner particles of low charge/toner particle mass ratio in order to obtain a visible continuous tone image.

The developer of the present invention contains in a hydrocarbon liquid having a volume resistivity of at least $10^9$ Ohm.cm and a dielectric constant of less than 3, a suspended toner comprising pigment particles, e.g. carbon black particles, bearing organic polymeric material on their surfaces, and at least one ionic surfactant in the absence of which the toner particles would not be able to develop a negative surface charge pattern possessing a charge level corresponding to 50 V for a capacitance of $1.5\times10^{-11}$ F.cm$^{-2}$ up to an optical density of at least 0.8, characterised in that the developer contains a metal alkyl sulphonate ionic surfactant in which the metal ion is a bivalent metal ion selected from the group consisting of zinc(II), lead(II), cadmium(II) and copper(II) or is a trivalent metal ion of the group VIII of the Periodic Table of the Elements, e.g. iron(III) or of the group VI B e.g. chromium(III), and in which the sulphonate group is present directly on an alkyl chain containing at least 6 carbon atoms in a straight chain, which sulphonate has a positive charging effect on said toner, and in that the sizes of said toner particles and the amount in which said sulphonate is present are such that the toner can develop a charge pattern having the said charge level, up to an optical density of at least 0.8.

In a developer according to the invention, the toner particles may in the absence of the metal alkyl sulphonate be electrically inert or may be in charged state in which latter case the metal alkyl sulphonate serves to confer on the toner particles a charge level different from that which these would otherwise possess.

For a given charge density of the charge carrying surface the maximum development density attainable with toner particles of a given size is determined by the charge/toner particle mass ratio, which is determined by the amount of metal alkyl sulphonate employed. A suitable amount of the sulphonate for a given toner developer can easily be determined by simple tests. By using a said metal alkyl sulphonate as charge control agent, the specified results can be achieved with toner particles of a size commonly used in the electrophotographic art e.g. with toner particles sizing in the range of 0.2 $\mu$m to 2 $\mu$m.

The insulating liquid used as a carrier fluid may be any of the conventional electrically insulating carrier liquids generally employed in liquid developer compositions. The said liquid may be a hydrocarbon solvent e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons preferably having a boiling range between 150° C. and 220° C. such as the ISOPARS G, H, K and L (Trade Marks) of Exxon and SHELLSOL T (Trade Mark) of the Shell Oil Company.

The colouring agent used in the toner particles may be any of the pigments and solid dyestuffs commonly employed in liquid electrostatic toner compositions. Thus, for example, use can be made of carbon black and analogous forms thereof e.g. lamp black, channel black and furnace black e.g. RUSS PRINTEX 140 GEPERLT (trade-name of DEGUSSA — Frankfurt/M, W. Germany).

Typical organic pigments are so-called pigment dyes which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (tradename of Badische Anilin- & Soda-Fabrik AG, Ludwigshafen, Western Germany), HELIOGENBLAU LG (trade-name of BASF for a metal-free phthalocyanine blue pigment), MONASTRAL BLUE (a copper phthalocyanine pigment, C.I. 74, 160). HELIOGENBLAU B Pulver (trade-name of BASF), HELIOECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Patent Specification Nos. 1,394,061 filed Dec. 23, 1963 by Kodak Ltd. and 1.439.323 filed April 27, 1965 by Haris Intertape Corporation.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 1.

Table 1

| | PRINTEX 140 | PRINTEX G |
|---|---|---|
| origin | channel black | furnace black |
| density | 1.6 g.cm$^{-3}$ | 1.6 g.cm$^{-3}$ |
| grain size before entering the developer | 29 nm | 51 nm |
| oil number (g of linseed oil absorbed by 100 g of pigment) | 360 | 250 |
| specific surface (sq.m per g) | 96 | 31 |
| volatile material % by weight | 6 | 2 |
| pH | 5 | 8 |
| colour | brown-black | bleu-black |

As colour corrector for the PRINTEX pigments preferably minor amounts of copper phthalocyanine are used, e.g. from 1 to 20 parts by weight with respect to the carbon black.

The essential characteristic of the organic polymeric material is its property to adhere to the colouring agent and to serve as a protective colloid in non-aqueous medium. The organic polymeric material on the pigment particles operates as a dispersing aid and may be considered as an oleoresinous wetting agent. The coating of polymeric material confers on the toner developers a better shelf life stability.

Suited polymers for that purpose are, e.g.:

poly(iso)alkyl (meth)acrylates and copolymers with styrene and vinyltoluene
copolymers of styrene, vinyltoluene and indene
copolymers of styrene and butadiene
polyvinyl ethers and copolymers with ethyl acrylate
polyisobutylene
polyvinylacetate and copolymers of vinylacetate e.g. copolymers of vinylacetate and ethylene
copolymers of coumarone and indene
silicone resins
polyvinyl stearate
alkyd resins
cyclized rubbers as described e.g. in published German Patent Application No. 2,165,458 filed Dec. 29, 1971 by Ricoh
epoxy resins.

Preferred polymers are alkyl methacrylate polymers and copolymers, e.g. with vinyl toluene, that contain a small amount (less than 1% by weight of free carboxylic acid groups e.g. NEOCRYL B 702 (trade-name of Polyvinyl Chemie — Holland, Waalwijk, Netherlands for a copolymer of isobutyl methacrylate, stearyl methacrylate and methacrylic acid having the following structure:

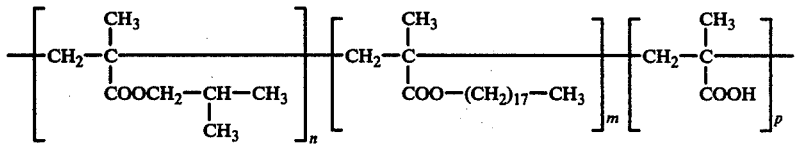

wherein:

n = 75–85% by weight
m = 15–25% by weight
p = about 0.2% by weight

Another polymer that yields particularly high density results in a developer composition according to the present invention comprising said alkyl sulphonate surfactant corresponds to the following general formula:

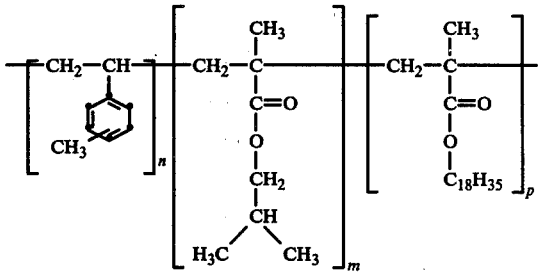

wherein n = 60% by weight
m = 20% by weight
p = 20% by weight

Preferred alkyl sulphonates for use according to the present invention contain an alkyl chain of 16 to 18 carbon atoms. Examples thereof are listed in the following Table 2.

Table 2

| Compound Nr. | Structural formula |
|---|---|
| 1 | 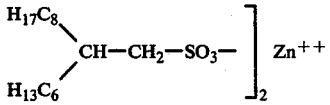 |

Table 2-continued

| Compound Nr. | Structural formula |
|---|---|
| 2 | 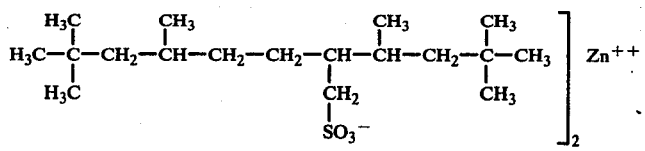 |
| 3 | 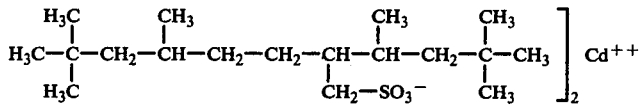 |
| 4 | 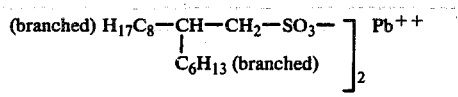 |
| 5 | 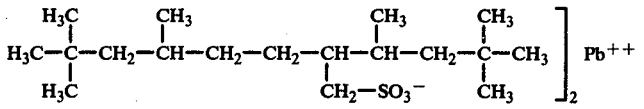 |
| 6 | 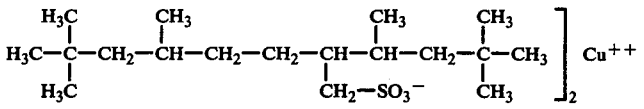 |

The preferred metal alkylsulphonates for use according to the present invention are zinc salts.

The preparation of said metal salts of alkyl sulphonic acids proceeds starting from the corresponding sulphonic acids which are converted in the desired bivalent or trivalent metal salts using the corresponding acetate.

The alkyl sulphonic acids are prepared e.g. as described in the U.S. Pat. No. 3,793,032 of Robert Joseph Pollet, Marcel Cyriel De Frê and Arthur Henri De Cat issued February 19, 1974.

For illustration purpose a detailed description of the preparation of compound 1 of the above Table is given hereinafter.

Preparation of zinc-2-hexyldecylsulphonate

While stirring 51.6 g of 2-hexyldecylmercaptan (0.2 mole) are added dropwise over a period of 1 h to 140 ml of nitric acid (d = 1.4) at 40° C. Stirring is continued for 1 h. The obtained reaction mixture is poured in 400 ml of ice water. The separated oily substance is dissolved in 100 ml of methylene chloride and the organic liquid phase washed twice with 400 ml of cold water.

26.4 g of zinc acetate dihydrate (0.12 mole) dissolved in 400 ml of water are added to said organic phase and thoroughly mixed therewith for 30 min whilst heating up to 40° C. The organic liquid phase is separated and the volatile material removed under reduced pressure (15 mm Hg). The residue is dried at 70° C. under vacuum (1 to 2 mm Hg). The alkyl sulphonic acid zinc salt is obtained as a yellow very viscous oil. Yield: 65 g.

Generally speaking good results can be achieved with the defined metal alkyl sulphonates in amounts of between 1.0 to 0.1% by weight with respect to the total weight of colouring agent(s).

The organic polymers may be used in amounts of between 10% to 100% by weight with respect to the total weight of colouring agent(s).

The polymeric material can be applied as a pre-coating on the pigment particles prior to their use in making up the developer or can be introduced as a separate ingredient in the liquid and allowed to become absorbed onto the pigment particles.

It is generally suitable for the electrophoretic liquid developer to incorporate the toner in an amount between 1 g and 20 g per liter, preferably between 2 g and 10 g per liter.

The metal alkyl sulphonates of the present invention increase only very poorly the electrical conductivity of the developer liquid. An enrichment of said metal alkyl sulphonate charge control agent in the developer as a result of toner depletion has no substantial influence on the conductivity of the electrophoretic developer of the present invention.

The toner developers according to the present invention have a good storage keepability. The toner particles are kept in suspension through a diffuse electrical double layer. The size of the positively charged toner particles is preferably between 0.4 and 2 μm more preferably between 0.5 and 1 μm. The charge per particle is preferably about $10^{-18}$ C and the zeta (ζ) potential larger than 20 mV.

A preferred electrophoretic developer according to the present invention contains the following ingredients in isododecane.

| Function | Name | Amount |
|---|---|---|
| colouring agent | - PRINTEX 140 (trade-name) | 95 parts by weight |
| | - HELIOECHTBLAU HG (trade-name) | 5 parts by weight |
| polymeric fixing agent | - NEOCRYL B 702 (trade-name) | 25 parts by weight |
| charge control agent | - zinc-2-hexyldecyl-sulphonate | 0.4% by weight with respect to the total weight of colouring agent |
| | - zinc-2-butyloctyl- | 40 ppm with res- |

-continued

| Function | Name | Amount |
|---|---|---|
| | phosphate | pect to the total weight of colouring agent |

As can be learned from said composition an additional ionic charge control agent may be used in minor amounts e.g. from 10 to 50 ppm with respect to the total weight of colouring agent(s), and preferably not more than 2% by weight with respect to the metal alkylsulphonate. For improving the stability of the charge/-toner particle mass ratio over a long period of time (several months), it is preferred to employ for additional ionic charge control a positively working control agent which is a bivalent or trivalent metal salt of:

(a) a monoester or diester of an oxyacid derived from phosphorus, (b) an oxyacid derived from phosphorus and containing one or two organic radicals linked to the phosphorus atom by a carbon atom, or (c) an oxyacid derived from phosphorus and containing an ester group and an organic radical linked by a carbon atom to the phosphorus atom, the said organic radical being aliphatic, cycloaliphatic or aromatic.

The salt constituting the additional control agent comprises an organic residue e.g. at least one organic radical and/or ester group rendering the salt substantially soluble in the electrically insulating carrier liquid. The organic residue preferably comprises a chain of at least 4 carbon atoms, most preferably from 10 to 18 carbon atoms, and such chain may be substituted and or interrupted by hetero-atom(s), e.g., oxygen, sulphur, or nitrogen atom(s).

The solubility in the electrically insulating carrier liquid of such metal salts can be promoted by the presence of one or more organic radicals with branched structure, e.g. branched aliphatic radicals, such as a 2-butyl-octyl radical.

Excellent results are obtained when a zinc salt is used as an additional control agent. However, other salts may also be used for example magnesium salts, calcium salts, strontium salts, barium salts, iron salts, cobalt salts, nickel salts, copper salts, cadmium salts, aluminium salts and lead salts.

More details about these bivalent or trivalent metal salts, representative examples thereof and methods of preparing these salts can be found in United Kingdom patent specification No. 1,151,141 filed Feb. 4, 1966 by Gevaert-Agfa N. V. and U.S. Pat. No. 3,793,015 of Jozef Leonard Van Engeland, Noel Jozef De Volder, Bernard Hippoliet Tavernier and Albert Lucien Poot issued Feb. 19, 1974.

The above metal salts of the oxyacids of phosphorus are preferably added after the colouring material has been dispersed with the aid of the metal alkylsulphonate.

The liquid developer composition can be prepared by using dispersing and mixing techniques well known in the art. It is conventional to prepare by means of suitable mixers e.g. a 3-roll mill, ball mill, colloid mills, high speed stirrers, a concentrate e.g. 15 to 80% by weight of solids in the insulating carrier liquid of the materials selected for the composition and subsequently to add further insulating carrier liquid to provide the liquid toner composition ready for use in the electrostatic reproduction process.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exagerated density gradients which may be of interest e.g. in certain medical X-ray images for diagnostic purposes.

The following examples illustrate the present invention.

EXAMPLE 1

In a ball-mill with a capacity of 140 l filled with 105 kg of steatite balls (diameter: 10 mm, specific gravity: 2.34) the following products were introduced successively:

2.1 kg of 30% solution of NEOCRYL B 702 (trade-name) in ISOPAR G (trade-name)
0.2 l of 5% solution of zinc 2-hexyldecyl sulphonate in isodecane
2.375 kg of PRINTEX G (trade-name)
0.125 kg of HELIOECHTBLAU HG (trade-name)
6 l of isododecane and ground at 42 rpm for 15 h whereupon it is diluted with isodecane so as to obtain a toner concentrate in 16% by weight concentration.

For preparing 1 l of actual developer 25 ml of this toner concentrate were diluted with 975 ml of isododecane. This developer was used for developing an electrostatic image obtained as follows:

to one side of a non-stretched polyethylene terephthalate film of 0.8 mm thickness a subbing layer was applied at 25° C. at a coverage of 5 g/sq.m from a latex containing 20% by weight of the copolymer of vinylidene chloride, vinyl chloride, n-butyl acrylate and itaconic acid (30:50:18:2 by weight), whose preparation has been described in the United Kingdom patent specification No. 1,234,755 filed Sept. 28, 1967 by Gevaert-Agfa N. V.

This subbed film was simultaneously stretched longitudinally and transversally to about 10 times its original size. The thickness of the film was 180 μm after stretching.

A thermo-adhesive fixing layer (5 μm thick) was applied to the subbed film by coating it at 25° C. at a coverage of 70 g per sq.m with a 10% (weight/volume) NEOCRYL B 707 (trade-name) of Polyvinyl Chemie — Holland, Waalwijk, Netherlands for a copolymer of vinyltoluene, isobutyl methacrylate and stearyl methacrylate (60/20/20 by weight) polymer solution in a 3/1 by volume mixture of dichloroethane and methylene chloride.

The dried film was electrostatically charged at the side of the thermo-adhesive subbing layer with a negative corona of which the ion stream was directed through image-wise distributed apertures in a copper plate while the rear side of the film was held in contact with a copper plate during charging.

The corona charge was of such an intensity that the average voltage of the charge applied to the subbed layer was − 50 V just before development.

A visible image was obtained having only slight graininess, a good uniformity and an optical density equal to 1.0 (measured by transmitted light) at 50 V due to the surface charge (about $10^{-9}$ C) as it is measured with an electrometer just before the development. The electrometer used in the measurement is a vibrating-probe electrometer as described in RCA Review Vol. XV December 1954, no. 4, p. 483, the probe being held at about 1 mm from the film sample. The capacitance of the charged film is $1.53\times10^{-11}$ F.cm$^{-2}$.

The storage life of the above prepared developer is more than 5 months.

EXAMPLES 2–7

Example 1 was repeated with the same developer but after the zinc 2-hexyldecylsulphonate had been replaced by a same amount of one of the following products:

lead 2-hexyldecylsulphonate (Example 2)
cadmium 2-hexyldecylsulphonate (Example 3)
cadmium 2-(1',3',3'-trimethylbutyl)-5,7,7-trimethyloctylsulphonate (Example 4)
copper 2-(1',3',3'-trimethylbutyl)-5,7,7-trimethyloctylsulphonate (Example 5)
lead 2-(1',3',3'-trimethylbutyl)-5,7,7-trimethyloctylsulphonate (Example 6)
zinc 2-(1',3',3'-trimethylbutyl)-5,7,7-trimethyloctylsulphonate (Example 7)

All these products yielded an image quality almost equally good as that obtained in example 1.

EXAMPLES 8–10

Example 1 was repeated with the same developer but after the zinc 2-hexyldecylsulphonate had been replaced by a same amount of one of the following products:

a sodium alkylsulphonate (sold under the trade-name ACTO 500 by EXXON, U.S.A. (Example 8);
sodium dioctylsulphosuccinate (sold under the trade-name AEROSOL OT by American Cyanamid Corp. U.S.A. (Example 9);
a calcium petroleum sulphonate (sold under the trade-name TEXACO TLA 414 by Texaco, U.S.A. (Example 10).

In none of these cases there was any deposition of toner particles according to the process of Example 1 and no image density was achieved either. Indeed, on checking the developers in an electrophoresis cell it was found that the toner particles obtained were substantially negatively charged and that as a result they practically exclusively deposited on the anode.

EXAMPLE 11

Example 1 was repeated with the same developer but after the zinc 2-hexyldecylsulphonate had been replaced by a same amount of zinc 2-butyloctylphosphate. Just as in examples 1 to 8 a developer with positively charged toner particles was obtained but as contrasted with examples 1 to 8 a very high positive charge per particle was obtained so that the image density reached was very low in comparison with that of example 1, viz. at 50 V it was lower than 0.5.

EXAMPLE 12

Preparation of the organic polymer used for coating carbon black as colouring material A. Preparation of methacrylic acid ester of hydrogenated abietyl alcohol (ABITOL).

2 moles of diethylaniline and 0.5 g of m-dinitrobenzene were added to a solution of 2 moles of ABITOL (trade name of The Hercules Powder Company, USA for a mixture formed of about 15% of non-alcoholic material, the alcohol portion being formed of about 45% of tetrahydroabietyl alcohol, 40% of dihydroabietyl alcohol and 15% of dihydroabietyl alcohol) dissolved in 2 liters of benzene free from thiophene and water. Thereafter 2.5 moles of methacryloyl chloride were added in 1 h while stirring at room temperature. After having been stirred for 2 h at room temperature, the solution was stirred for 1 h more at reflux temperature, whereafter the solution was cooled overnight. During cooling the diethylaniline hydrochloride formed crystallized out. This precipitate was filtered off and the filtrate was consecutively washed with 2N hydrochloric acid, a saturated aqueous sodium hydrogen carbonate solution and water until neutral. The solution in benzene was dried with magnesium sulphate, whereafter the benzene was evaporated. An amount of 620 g of a thick viscous oil obtained was fractionated. Only the fraction distilling between 150 and 210° C. at a pressure of 0.7–1 mm Hg was retained. The structure of the ester was confirmed by infrared analysis.

B. Preparation of the coating polymer 50 g of the methacrylic acid ester of hydrogenated abietyl alcohol, prepared as specified in A above, and 50 g of isobutyl methacrylate were dissolved in 400 ml of benzene. Then 0.1 to 0.2 g of azobisisobutyronitrile was added and the polymerisation was carried out at 80° C. up to completion, which lasted about 24 h. The obtained polymer had an intrinsic viscosity of 0.4 dl.g$^{-1}$.

Preparation of the polymer-coated pigment particles

In 100 ml of the polymer solution prepared according to B above, 100 g of PRINTEX G (trade name) were dispersed by ball-milling for 2 h. Thereupon the benzene was distilled whereby a dry powder is obtained containing carbon black particles having precipitated polymer thereon. According to another technique the polymer coating is applied by spraying the dispersion (spray-drying) in a vessel kept under reduced pressure for evaporating the benzene.

Preparation of the electrophoretic developer 375 g of the polymer-coated carbon black particles, which contain the carbon black and polymer in a ratio by weight of about 4 to 1, were dispersed in a ball-mill in the presence of 18.5 ml of a 2% (grams to 100 ml) solution of zinc 2-hexyldecylsulphonate in 1125 ml of ISOPAR G (trade name) for 30 h. From the obtained toner concentrate 16 ml were diluted with ISOPAR G (trade name) to 1 liter. A positive toner was obtained, which under the development conditions of Example 1 gives practically the same results.

When used for electrophoretic development of a charge on a polyethylene terephthalate film of 180 μm (capacitance = $1.57\times10^{-11}$ F.cm$^{-2}$) being charged up to 100 V a toner deposit of an optical density 2.0 was obtained.

We claim:

1. A liquid developer composition suitable for use in developing electrostatic charge patterns, which composition contains, in an electrically insulating carrier liquid having a volume resistivity of at least $10^9$ Ohm.cm and a dielectric constant below 3, a suspended toner comprising pigment particles bearing organic polymeric material on their surfaces, and at least one ionic surfactant in the absence of which the toner particles would not be able to develop a negative surface charge pattern possessing a charge level corresponding to 50 V for a capacitance of $1.5 \times 10^{-11}$ F.cm$^{-2}$ up to an optical density of at least 0.8, said ionic surfactant being a metal alkyl sulphonate in which the metal ion is a bivalent metal ion selected from the group consisting of zinc(II), lead(II), cadmium(II) and copper(II) and in which the sulphonate group is present directly on an alkyl chain containing at least 6 carbon atoms in a straight line and has a positive charging effect on said toner, the sizes of said toner particles and the amount in which said sulphonate present being selected such that the toner can develop a charge pattern having said charge level up to an optical density of at least 0.8.

2. A liquid developer composition according to claim 1, wherein at least one zinc salt is present as said metal alkyl sulphonate.

3. A liquid developer composition according to claim 1 wherein the composition includes a minor amount of a bivalent or trivalent metal salt of a monoester or diester of an oxyacid derived from phosphorus.

4. A liquid developer composition according to claim 3, wherein a minor amount of the zinc salt of mono-2-butyloctylphosphate is present.

5. A liquid developer composition according to claim 1, wherein the alkyl group of the sulphonate contains from 16 to 18 carbon atoms.

6. A liquid developer composition according to claim 1, wherein the pigment particles are carbon black particles.

7. A liquid developer composition according to claim 1, wherein the insulating carrier liquid is an aliphatic hydrocarbon.

8. A liquid developer composition according to claim 7, wherein said carrier liquid is isododecane.

9. A liquid developer composition according to claim 1, wherein the said organic polymeric material comprises a copoly(isobutyl methacrylate/stearyl methacrylate/methacrylic acid)(84.8/15/0.2 by weight).

10. A liquid developer composition according to claim 1, wherein the positively charged toner particles have a size in the range of 0.5 to 1 $\mu$m.

11. A liquid developer composition according to claim 1, wherein the charge per toner particle is about $10^{-18}$ C.

12. A liquid developer composition according to claim 1, wherein the metal alkylsulphonate is present in an amount of from 1.0 to 0.1% by weight with respect to the total weight of colouring agent.

13. A method of forming a liquid developer composition suitable for use in developing electrostatic charge patterns, and comprising a positively charged toner suspended in an electrically insulating carrier liquid having a volume resistivity of at least $10^9$ Ohm.cm and a dielectric constant below 3; which method comprises dispersing pigment particles in the said liquid in the presence of an organic polymeric material which becomes adsorbed on said pigment particles, and incorporating in the liquid a metal alkylsulphonate ionic surfactant which has a positive charging effect on the toner formed by said pigment particles with adsorbed polymeric material, the metal ion of said sulphonate being a bivalent metal ion selected from the group consisting of zinc(II), lead (II), cadmium(II), and copper(II) and the sulphonate group thereof being present directly on an alkyl chain containing at least 6 carbon atoms in a straight line, said sulphonate and polymer being present in such an amount with respect to the pigment particles that the toner is capable of developing a negative surface charge pattern possessing a charge level of 50 V for a capacitance of $1.5 \times 10^{-11}$ F.cm$^{-2}$ to an optical density of at least 0.8.

14. A method according to claim 13, wherein said dispersion is effected with the aid of said metal alkylsulphonate and a minor amount of a bivalent or trivalent metal salt of a monoester or diester of an oxyacid derived from phosphorus.

15. A method according to claim 14, wherein a zinc salt is used as said sulphonate and/or as a said salt of a phosphorus oxyacid.

16. A method according to claim 13, wherein the alkyl group of the sulphonate contains 16 to 18 carbon atoms.

17. A method according to claim 13, wherein the pigment particles are carbon black particles.

18. A method according to claim 13, wherein the organic polymer is a copoly(isobutyl methacrylate/stearyl methacrylate/methacrylic acid) (84.8/15/0.2 by weight).

* * * * *